United States Patent [19]

Tamagne

[11] Patent Number: 4,635,353

[45] Date of Patent: Jan. 13, 1987

[54] METHOD FOR POSITIONING TWO SENSOR DEVICES

[75] Inventor: Henry J. Tamagne, Dearborn, Mich.

[73] Assignee: Ford Motor Company, Dearborn, Mich.

[21] Appl. No.: 739,344

[22] Filed: May 30, 1985

[51] Int. Cl.[4] ..... H01F 41/00

[52] U.S. Cl. ..... 29/602 R; 29/593; 123/146.5 A; 123/617

[58] Field of Search ..... 29/602 R, 407, 593; 123/146.5 A, 617

[56] References Cited

U.S. PATENT DOCUMENTS 4,185,600 1/1980 Brammer et al. .
4,235,213 11/1980 Jellissen .
4,373,486 2/1983 Nichols et al. .
4,407,258 10/1983 Ruf .
4,459,968 7/1984 Brandt et al. .

*Primary Examiner*—Carl E. Hall
*Attorney, Agent, or Firm*—Peter Abolins; Keith L. Zerschling

[57] ABSTRACT

Two Hall sensor devices are positioned at a predetermined angular position with respect to each other, and with respect to a distributor, by mounting a first Hall sensor in a primary carrier, forming a first alignment means at a firing point of the first Hall sensor, mounting a second Hall sensor in a secondary carrier, and forming a second alignment means in the secondary carrier at the firing point of the second Hall sensor. A third alignment means is formed in the primary carrier at the predetermined angle from the first alignment means and the secondary carrier is mounted to the primary carrier so that the second and third alignment means are aligned and the two Hall sensors provide output signals displaced by the predetermined angular rotation.

7 Claims, 14 Drawing Figures

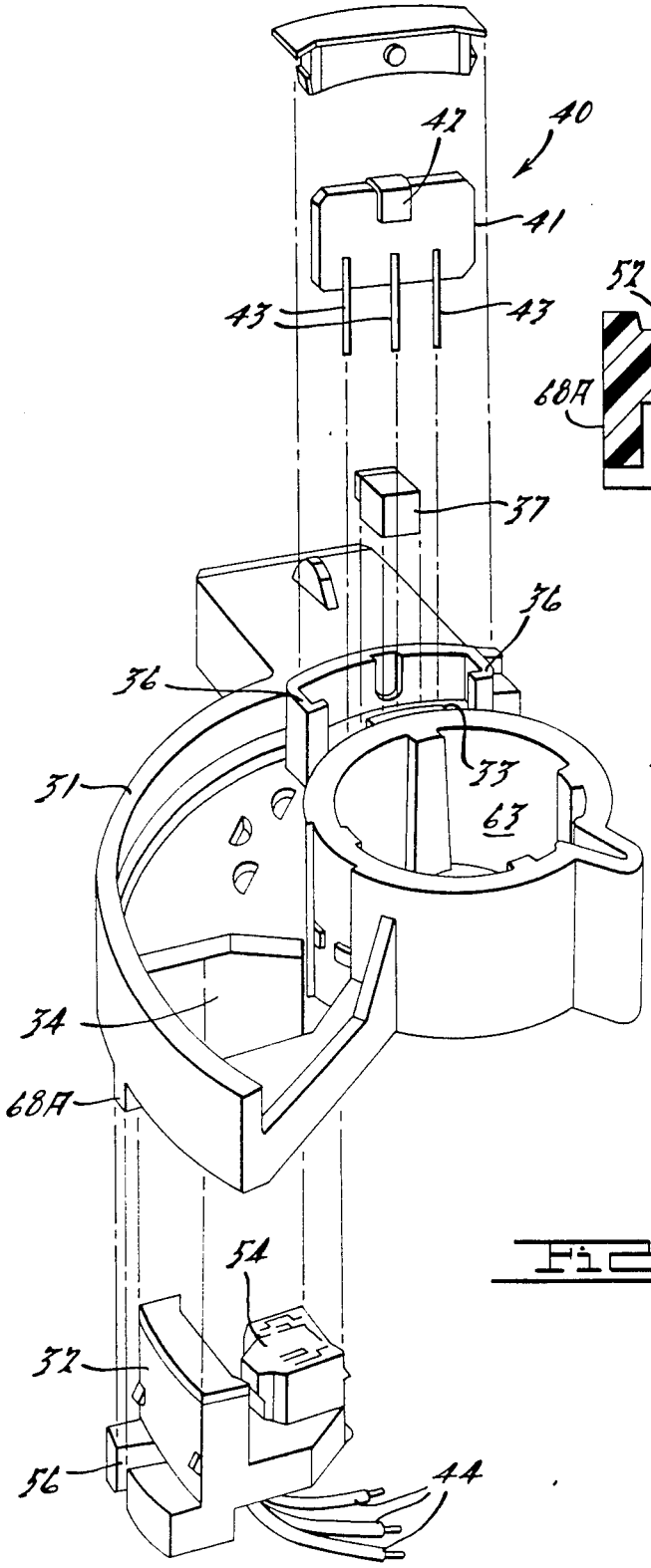
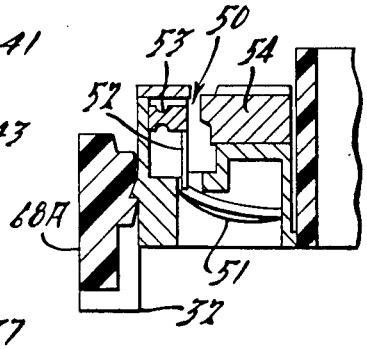
Fig. 3.
Fig. 2.

METHOD FOR POSITIONING TWO SENSOR DEVICES

BACKGROUND OF THE INVENTION

1. Field of the Invention

This invention relates to housings and methods of assembling automotive ignition distributor components.

2. Prior Art

Hall effect devices produce an output voltage proportional to the magnetic flux passing through the device. Such Hall-effect sensors can be used in automotive systems to provide timing systems for automotive ignition distributor systems and for fuel injection systems. For example, a distributor shaft can be coupled to the engine and have an attached rotor member with a plurality of peripheral vane members extending outwardly. The vanes can be advantageously made of a high permeability ferrous material and successively pass through air gap in a magnetic circuit containing a Hall device positioned within the air gap. The flux which passes through the Hall device is shunted away from the Hall device by the vanes. This produces an electric output from the Hall effect device.

There are various known Hall effect sensor assemblies for use in automotive ignition distributor systems which are mounted in molded plastic holders. An air gap is provided for the passage of the vane through the holder and on each side of the air gap are molded portions for containing a magnetic and pole piece assembly and a circuit board assembly containing a Hall effect device and a flux concentrator. Since a molded holder has dimensions which will vary within certain tolerance limits, the relative positions of the circuit board, the concentrator, and the magnet and pole piece assembly with respect to each other are subject to variations. The method of assembling prior art components in the housing involves placing the components within predetermined molded recesses within the housing and fixing the components in place. Variation in the housing and component tolerances may provide for a variation in rotational position which would affect the timing provided by the Hall effect sensor.

A further problem exists when it is desired to use two Hall signal generator systems so that one can provide a signal for the ignition system and the other can provide a signal for the fuel injection system. It is often difficult to position the release point, or the firing point, of one Hall effect device with respect to the release point or firing point of the other Hall effect device. For example, it may be desired to position the two firing points exactly 90° apart. The time required to adjust for accurate firepoint positioning can be prohibitive on a mass production basis. It would be desirable to have an apparatus and method for simple, accurate placement of the two Hall effect devices as well as allowing complete replacement of the Hall effect holder for retaining the original accuracy and not requiring any adjustment at the point of final assembly to the distributor. These are some of the problems this invention overcomes.

U.S. Pat. No. 4,185,600 issued to Brammer et al and U.S. Pat. No. 4,235,213 issued to Jellissen teach Hall effect distributors and the assembly of a single Hall effect device in the distributor. U.S. Pat. No. 4,373,486 issued to Nichols et al, U.S. Pat. No. 4,407,258 issued to Ruf and U.S. Pat. No. 4,459,968 issued to Brandt et al disclose the use of two Hall effect devices, but without discussion of positioning one Hall effect device with respect to another Hall effect device. In particular, Nichols et al addresses the use of one magnet to operate with two Hall effect devices and having two shutters attached to the common shaft passing between the Hall effect device and the magnet. Thus, this patent does not address the location of one Hall effect device firepoint with respect to the other Hall effect device firepoint. The patent to Ruf addresses the functioning of two Hall effect signal generators mounted within the distributor to control spark timing to fire each cylinder and to control fuel injection. The patent does not address how to locate or position the two Hall effect devices accurately with respect to each other. The patent to Brandt et al teaches the use of one Hall effect device on a crankshaft flywheel and another Hall effect device on a camshaft.

SUMMARY OF THE INVENTION

This invention includes a method and apparatus for positioning two Hall sensor devices at a predetermined angular position with respect to each other and with respect to a distributor. The method includes mounting a first Hall sensor in a primary carrier, milling a first alignment means at a firing point of the first Hall sensor, mounting a second Hall sensor in a secondary carrier, milling a second alignment means in the secondary carrier at rhe firing point of the second Hall sensor, milling a third alignment means at a predetermined angle, e.g. 90°, from the first alignment means in the primary carrier and mounting the secondary carrier to the primary carrier so that the second and third alignment means are aligned and the first and second Hall sensors are thus positioned 90° apart to provide output signals displaced by 90° of rotation.

BRIEF DESCRIPTION OF THE DRAWINGS

FIG. 2 is an exploded, perspective view of a primary Hall sensor carrier for mounting a first Hall sensor and a secondary Hall sensor carrier for mounting a second Hall sensor at a predetermined angle with respect to the first Hall sensor, in accordance with an embodiment of this invention;

FIG. 3 is a cross section view of the mounting of the secondary Hall sensor carrier and second Hall sensor in the primary Hall sensor carrier along a section line III—III of FIG. 4;

FIGS. 7–14 show the sequential alignment process for establishing a predetermined angle between two Hall sensors, in accordance with an embodiment of this invention, wherein FIG. 7 shows the alignment of a primary Hall sensor carrier and an alignment tab from the distributor so that the firing point of the first Hall sensor is aligned with the tab;

FIG. 8 is a side view of the primary Hall sensor carrier after the formation of a slot to receive the alignment tab from the distributor;

FIG. 9 shows a side view of the primary carrier at a predetermined angle from the first Hall sensor including an untrimmed alignment tab;

FIG. 10 shows the primary Hall carrier after trimming of the second alignment tab;

FIG. 11 is a side view of a secondary Hall sensor carrier;

FIG 12 is a side view of a secondary Hall sensor carrier after formation of a slot aligned with the firing point of the second Hall sensor;

FIG. 13 is a side view of a mounted secondary Hall sensor carrier so that the trimmed alignment tab in the primary Hall sensor engages the slot in the secondary Hall sensor carrier; and FIG. 14 is a side elevation view of the primary and secondary Hall sensor carriers mounted on the alignment tab of the distributor.

DETAILED DESCRIPTION OF THE INVENTION

Figure 1:
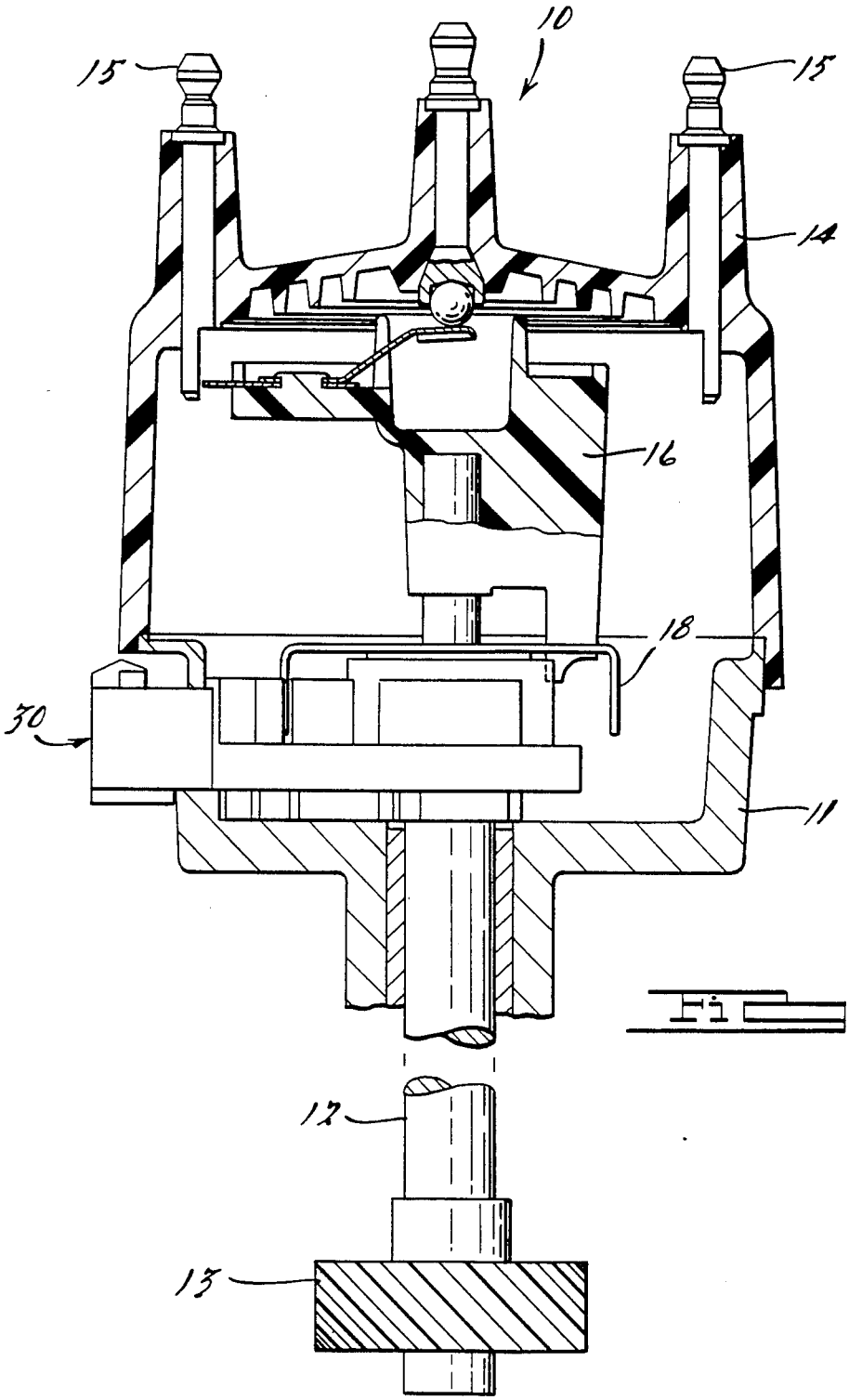
FIG. 1 is a cross section view of a Hall sensor carrier positioned in a distributor.
Figure 4:
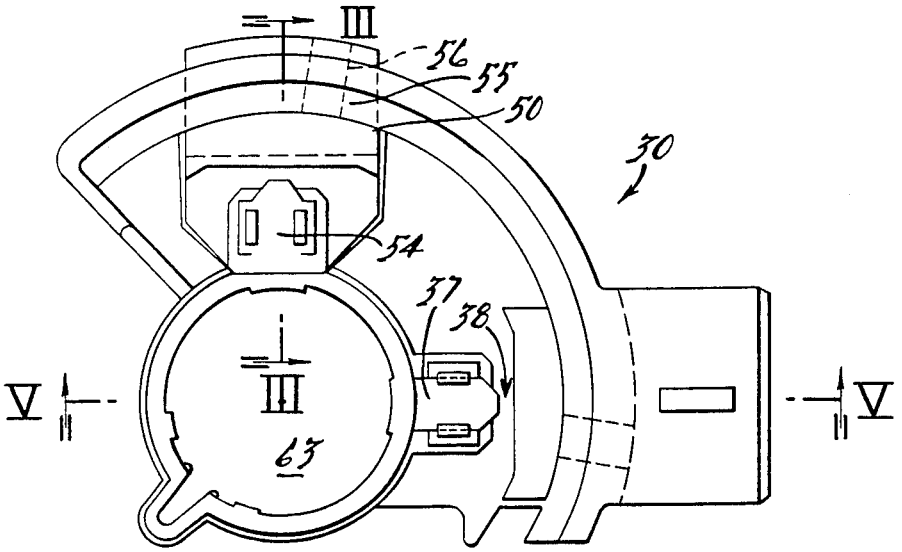
FIG. 4 is a top plan view of a Hall sensor carrier in accordance with an embodiment of this invention.
Figure 5:
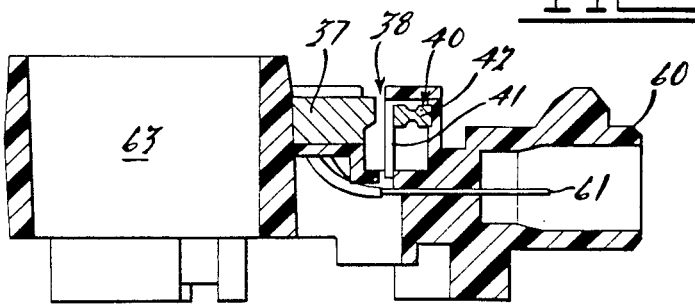
FIG. 5 is a section view along section line V—V of FIG. 4 of a Hall sensor carrier including the mounting of the first Hall sensor in the primary Hall sensor carrier, in accordance with an embodiment of this invention.
Figure 6:
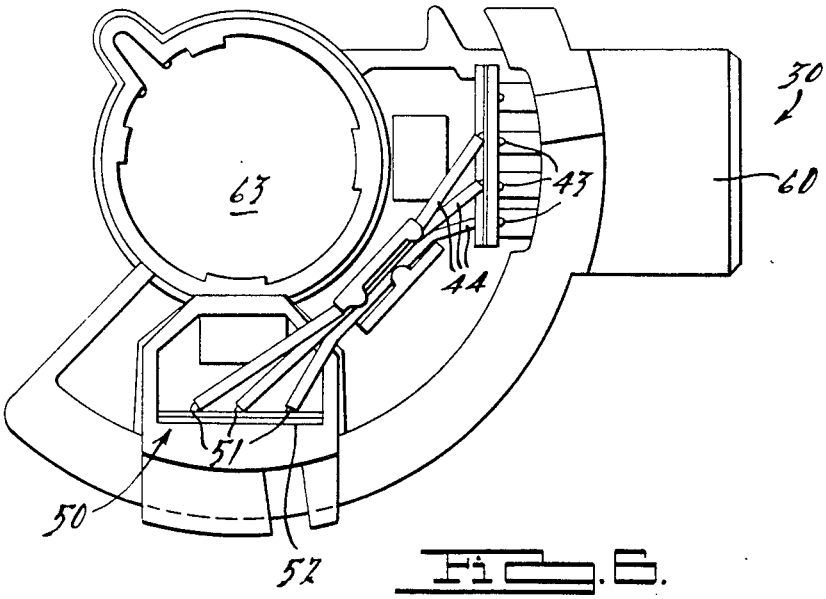
FIG. 6 is a bottom plan view of a Hall sensor carrier in accordance with an embodiment of this invention.

Referring to FIG. 1, an automotive ignition distributor system 10 includes a distributor base assembly 11. Contained within the distributor base 11 is a distributor shaft 12 which is rotatable about an axis in synchronism with various other mechanical components of an automotive engine by coupling using a gear 13, as is well known in the art. Distributor system assembly 10 also includes a distributor cap assembly 14 which mates to distributor base assembly 11 and provides for distribution of spark firing energy through output terminals 15 positioned in distributor cap assembly 14.

Mounted on an end of distributor shaft 12 is a rotor assembly 16 which has peripherally mounted and downwardly extending vanes 18. Vanes 18 are curved, ferrous, relatively thin plates having a high magnetic permeability which provides a shunt path for magnetic flux.

A Hall sensor carrier 30 includes a primary Hall sensor carrier 31 for carrying a first and second Hall sensor adjacent magnetic paths which are interrupted by vanes 18 so as to produce an output signal in response to passage of vanes 18.

Referring to FIGS. 3–6, Hall sensor carrier 30 includes a primary Hall sensor carrier 31 and a secondary Hall sensor carrier 32. Primary Hall sensor carrier 31 has a generally arcuate shape with an opening 33 for receiving a first Hall sensor assembly 40 and an opening 34 for receiving secondary Hall sensor carrier 32 including a Hall sensor assembly 50. Openings 33 and 34 are positioned so that Hall sensor assemblies 40 and 50 can be positioned at approximately 90° apart. The exact placement of the firing points of each of Hall sensor assemblies 40 and 50 exactly 90° apart is explained later with respect to FIGS. 7–14.

Hall sensor assembly 40 includes a circuit board 41 which supports a Hall sensor 42. Terminals 43 are coupled to wires 44 which are connected to terminals 51 of secondary Hall sensor assembly 50. Hall sensor assembly 50 also includes a circuit board 52 having thereon a Hall sensor 53. In addition to supporting Hall sensor assembly 50, secondary Hall sensor carrier 32 also supports a magnet 54 spaced from Hall sensor 53 to provide therebetween an air gap for passing vanes 18. A protruding tab 55 extends down from primary Hall sensor carrier 31 to mate with a receiving slot 56 of secondary Hall sensor carrier 32 so as to angularly position secondary Hall sensor carrier 32 with respect to distributor shaft 12.

Primary Hall sensor carrier 31 has a pair of guides 36 for receiving Hall sensor assembly 40. A magnet 37 is spaced radially inwardly from Hall sensor assembly 40 to provide a gap 38 therebetween to pass vanes 18. Extending radially outwardly of primary Hall sensor carrier 31 is a plug housing 60 containing terminals 61 for receiving signal from Hall sensor assemblies 40 and 50 as vanes 18 pass in the adjacent air gap. Primary Hall sensor carrier 31 has a central opening 63 for passing distributor shaft 12 and permitting distributor shaft 12 to rotate with respect to primary Hall sensor carrier 31.

Figure 7:
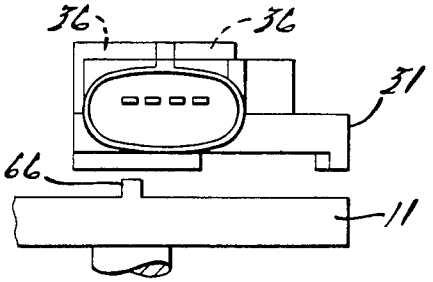
Figure 8:
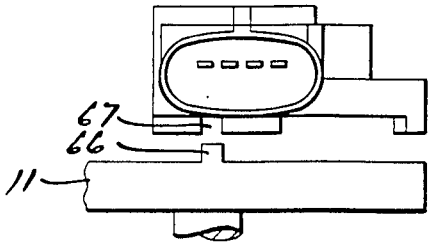

FIGS. 7–14 provide for the accurate positioning of Hall sensor assemblies 40 and 50. In FIG. 7, primary Hall sensor carrier 31 is rotationally positioned so that the firing point of Hall sensor assembly 40 occurs at the angular rotational position of a tab 66 coupled to distributor base assembly 11. An accurately positioned slot 67 is milled into the portion of primary Hall sensor carrier 31 adjacent tabs 66 so the two can be mated at the desired angular position.

To accurately position primary Hall sensor carrier at the desired position, a master tooth vane can be passed through the air gap between magnet 37 and Hall sensor assembly 40. Advantageously, the master tooth is fixed and primary Hall sensor carrier 31 is rotated about the same axis as that which supports the master tooth vane. With the Hall sensor 42 electrically connected to an oscilloscope, it is possible to establish the precise angular position of primary Hall sensor carrier 31 that fires the Hall sensor assembly 40 as observed on the oscilloscope. A closed tolerance locating notch 67 is milled into primary Hall sensor carrier 31. Such an accurately positioned locating tab 66 and locating notch 67 are advantageous when Hall sensor carrier 30 is replaced with another such Hall sensor carrier. No additional angular adjustment of the distributor is necessary. Typically, the positioning of the Hall sensor carrier with respect to a distributor base can be accomplished with a fire point accuracy of + and −0.2° maximum. Further improved accuracy can be obtained by closer tolerances on the milled slot and the locater in the distributor base.

Figure 9:
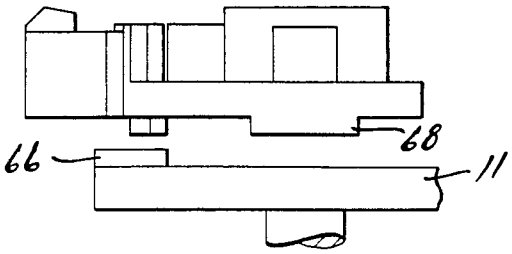
Figure 10:
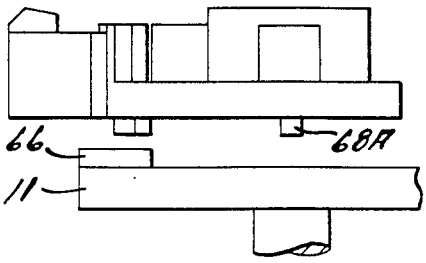
Figure 11:
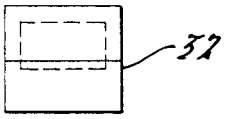
Figure 12:
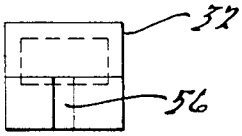

Referring to FIG. 9, extending along the angular position along primary Hall sensor carrier 31 and including 90° from milled slot 67, is an untrimmed tab 68. When primary Hall sensor carrier 31 is secured for the purpose of milling locating slot 67, the pair of milling cutters are accurately positioned to machine a close tolerance tab 68A (see FIG. 10). For example, once the milling heads are properly set up, tang 68A can be held with respect to notch 67 with an accuracy + and −0.1° or less.

Hall sensor assembly 50 and magnet 54 are assembled into secondary Hall sensor carrier 32. Secondary Hall sensor carrier 32 can fit within and is movable in opening 34 to permit some angular adjustment with the relative positions of Hall sensor carrier 32 and primary Hall sensor carrier 31.

As before with respect to Hall sensor assembly 40, secondary Hall sensor carrier 32, supporting Hall sensor assembly 50, is positioned with respect to a master vane and the Hall sensor 53 is electrically connected on an oscilloscope. Secondary Hall sensor carrier 32 is clamped in place and the angular position wherein Hall sensor 52 triggers from on to off as observed on the oscilloscope. At such angular position, a locating slot 56 is accurately milled into secondary Hall sensor carrier 32 for mating with locating tab 68A of primary Hall sensor carrier 31. (see FIGS. 11 and 12).

Figure 13:
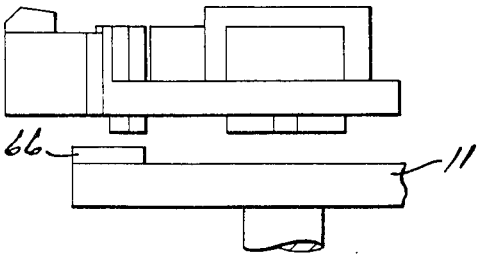

Referring to FIG. 13, the aligned mounting of secondary Hall sensor carrier 32 to primary Hall sensor carrier 31 is shown as completed.

Figure 14:
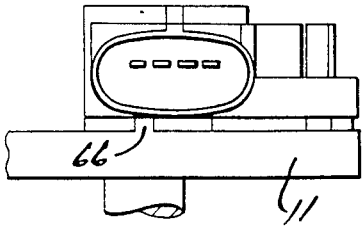

FIG. 14 is a side view adjacent Hall sensor assembly 40 showing primary Hall sensor carrier 31 mounted to locating tab 66 of distributor base assembly 11.

When secondary Hall sensor carrier 32 is snapped into place in primary Hall sensor carrier 31, Hall sensor assembly 50 carried by secondary Hall sensor carrier 32 is accurately positioned by locating tab 68A engaging slot 66. A typical accuracy of the fire point of Hall sensor assembly 50 is within + and −0.3° of the firing point of Hall sensor assembly 40 and a total assembly has an accuracy of + and −0.2° when installed on distributor base assembly 11.

Various modifications and variations will no doubt occur to those skilled in the arts to which this invention pertains. For example, a particular alignment in fastening slots and tabs may be varied from that disclosed herein. These and all other variations which basically rely on the teachings through which this disclosure has advanced the art are properly considered within the scope of this invention.

I claim:

1. A method of positioning two Hall sensor devices at a predetermined angular position with respect to each other on a distributor, including the steps of:

mounting a first Hall sensor in a primary carrier;

forming a first alignment means in the primary carrier at the firing point of the first Hall sensor;

mounting a second Hall sensor in a secondary carrier;

forming a second alignment means in the secondary carrier at the firing point of the second Hall sensor;

forming a third alignment means in the primary carrier at a predetermined angle from the first alignment means; and mounting the secondary carrier to the primary carrier so that the second and third alignment means are aligned and the first and second Hall sensors are thus positioned the predetermined angle apart to provide output signals displaced by the predetermined angular position.

2. A method of positioning two Hall sensor devices as recited in claim 1 wherein the step of forming the first alignment means includes milling a slot for mating with a mounting tang on a distributor for rotationally positioning the primary carrier with respect to a distributor.

3. A method of positioning two Hall sensor devices as recited in claim 2 wherein the step of forming the third alignment means includes milling a tang from an extending portion of the primary carrier.

4. A method of positioning two Hall sensor devices as recited in claim 3 wherein the step of forming the second alignment means includes milling a slot sized to mate with the tang for positioning the secondary carrier with respect to the primary carrier.

5. A method of positioning two Hall sensor devices as recited in claim 4 further comprising the steps of attaching the first Hall sensor to the primary carrier, the second Hall sensor to the secondary carrier, and the secondary carrier to the primary carrier and forming a reference indication on the distributor so that that entire assembly of the two Hall sensor devices can be positioned on a distributor in a predetermined desired rotational position.

6. A method of positioning two Hall sensor devices as recited in claim 5 wherein the step of forming the first alignment means includes sensing the output of the first Hall sensor in response to a changing magnetic flux so as to establish a switch point for the first Hall sensor.

7. A method of positioning two Hall sensor devices as recited in claim 6 wherein the step of forming the second alignment means includes sensing the output of the second Hall sensor in response to a changing magnetic flux so as to establish a switch point for the second Hall sensor.

* * * * *